US005118199A

United States Patent [19]

Howk

[11] Patent Number: 5,118,199

[45] Date of Patent: Jun. 2, 1992

[54] SIDE ENTRY MIXER APPARATUS

[75] Inventor: Richard A. Howk, Rochester, N.Y.

[73] Assignee: General Signal Corporation, Stamford, Conn.

[21] Appl. No.: 679,698

[22] Filed: Apr. 3, 1991

[51] Int. Cl.[5] ..... B01F 7/06

[52] U.S. Cl. ..... 366/292; 366/302; 366/306

[58] Field of Search ..... 366/302, 306, 307, 279, 366/305, 292, 297-300, 337

[56] References Cited

U.S. PATENT DOCUMENTS

| | | | |
|---|---|---|---|
| 61,691 | 1/1867 | Stanley . | |
| 272,516 | 2/1883 | Barnes . | |
| 531,718 | 1/1895 | Detwiler et al. . | |
| 1,580,778 | 4/1926 | Coverstone . | |
| 1,592,713 | 7/1926 | Bendixen . | |
| 2,139,430 | 12/1938 | Witham, Jr. . | |
| 2,661,668 | 12/1953 | Gruen | 366/302 |
| 2,854,223 | 9/1958 | Lee . | |
| 3,294,372 | 12/1966 | Davis et al. . | |
| 3,488,038 | 1/1970 | Staaf | 366/307 |
| 3,770,251 | 11/1973 | Herfeld . | |
| 3,782,696 | 1/1974 | Love . | |
| 3,887,169 | 6/1975 | Maynard . | |
| 4,468,130 | 8/1984 | Weetman . | |

*Primary Examiner*—Robert W. Jenkins
*Attorney, Agent, or Firm*—Martin Lukacher; M. E. Kleinman

[57] ABSTRACT

Side entering mixer apparatus has an impeller with an axis of rotation above and along the bottom of a tank in which the material (liquid or liquid suspension) to be mixed is disposed. In a discharge region in front of the impeller and in close proximity to the front of the impeller, there is disposed a flow straightening vane which removes substantially any radial component of flow. By removal of the radial flow component, helical flows which interact in the discharge region and cause pulsation of flow into the inlet region (between the rear surface of the impeller and the side wall of the tank from which it projects) are substantially eliminated and potentially catastrophic stress-induced failures in the side entering mixer and its seals are avoided.

22 Claims, 4 Drawing Sheets

SIDE ENTRY MIXER APPARATUS

DESCRIPTION

The present invention relates to improved apparatus for mixing (including agitating and circulating) liquids or liquid suspensions in a tank, and particularly to improved side entry mixer apparatus wherein the mixers produce flow in a direction across the bottom of the tank between the side walls thereof.

The invention is especially suitable for use in side entry mixer apparatus having a plurality of impellers which extend in generally the same direction from the side wall of a large diameter tank, by which is meant the diameter, or the length across a diagonal of the tank in the case of a tank of rectilinear cross section, is much greater than the diameter of the impeller. The present invention causes the stress on the impeller, its hub, the impeller shaft and the seals around the impeller shaft, where the shaft enters the tank through a side wall, usually via a nozzle extending from the side wall, to be reduced thereby providing long life reliable operation of the mixer apparatus. The invention is especially suitable for use in side entering mixers, where the material (the liquid or liquid suspension) which is mixed is viscous, such as at the viscosity presented by paper pulp. Such mixing applications give rise to stresses on the mixer shaft, the impeller, its hub and on the seals, which are substantially alleviated through the use of the invention.

In accordance with the present invention, the problem which gives rise to excessive stresses on the shaft, the impeller and the seals of a side entry mixer, and particularly a side entry mixer where a pair of impellers is used to produce flow volumes sufficient for the agitation of liquids and liquid suspensions, was recognized as arising out of the radial component of the flow produced by the impeller. The impeller is mounted close to the side wall of the tank and defines an inlet region for the impeller. The impeller has on its opposite side (the high pressure side), a discharge region. This discharge region is much longer than the inlet region, since it extends from the impeller to a location on the side wall opposite to the location from which the mixer (particularly the impeller and its shaft) projects. This radial component, together with the axial component of flow, creates a helical or twisting (tornado-like) flow in the discharge region. When this flow circulates back to the inlet region, it interferes with the inlet flow. This creates stresses on the impeller, its hub, the impeller shaft and the seals which can stress them beyond their limits. It has been found that flexural failures of these elements results. The problem is exacerbated in a dual, side entering mixer where the discharge regions overlap. Then the radial components of the flow interact and interfere causing the liquid in the tank to surge. The surging of the liquid extends into the inlet regions and produces the failure mode stresses on the impellers, their hubs and shafts and seals.

Once the cause of the stress failures was recognized, the reduction of the radial component of the flow provided the solution to the problem. In other words, the solution involves the straightening of the helical flow so that the flow becomes generally axial and enters the inlet region of the impeller smoothly, without surging. Applications of side entry mixers where the mixer is used in tanks of relatively small diameter or diagonal length compared to the diameter of the area swept by the impeller as it rotates (approximately the impeller's diameter), is not as severe as in large diameter or diagonal length tanks, since the longer flow paths amplify the surges. The viscosity of the material being circulated is another factor on which the magnitude of the interference in flow depends. This is believed to be a function of the time required for circulation, which is greater for more viscous material than for less viscous material. Without the incorporation of the invention to alleviate the radial component of the flow, as it enters the discharge region of each side entering impeller, many mixing applications, especially those involving large tanks and/or viscous materials, may not be achievable.

The conventional way of controlling radial flow from a side entering impeller is to angle the impeller to divert the flow (see U.S. Pat. Nos. 3,770,251 issued Nov. 6, 1973 and 3,294,372 issued Dec. 27, 1966). Various baffles have been used in order to prevent stagnation of the flow in the tank. See U.S. Pat. Nos. 2,139,430 issued Dec. 6, 1938; 2,854,223 issued Sept. 30, 1958; 272,516 issued Feb. 20, 1883; 1,592,713 issued July 12, 1926; 61,691 issued Jan. 29, 1867; 531,718 issued Jan. 1, 1895; 1,580,778 issued Apr. 13, 1926. Most of the baffles are employed along the walls of the tank. They are sometimes employed near the impellers. See U.S. Pat. No. 3,782,696 issued Jan. 1, 1974. None of these techniques are directed to eliminate surge-like conditions on the inlet side of a side entry impeller, nor have any of the foregoing patents recognized that the helical or "tornado"-like flow gives rise to these conditions.

Accordingly, it is the principal object of the present invention to provide improved side entering mixer apparatus, wherein mechanical loading and stresses on the impeller, its shaft and seals and the consequent surging in the electrical power required to drive the impeller are substantially eliminated.

It is a still further object of the present invention to provide improved side entry mixing apparatus in which the rotation of the flow in the discharge region of each impeller used in the apparatus is substantially eliminated.

It is a still further object of the present invention to provide improved side entering mixing apparatus where transients in the flow even created by the close proximity of the impeller to the side wall and bottom of the tank are substantially eliminated.

It is a still further object of the present invention to provide improved side entering mixer apparatus wherein the rotation in the flow which can give rise to destructive forces on the mixer, impeller shaft and seals, is substantially eliminated.

Briefly described, a mixer system embodying the invention has a tank in which a liquid or liquid suspension is circulated. The tank has a side wall and a bottom. Side entry mixer apparatus in the tank comprises a mixer shaft having an axis and an impeller on the shaft which is rotatable about the axis. The impeller projects into the tank from the side wall and defines a flow inlet region and a flow discharge region on opposite sides of the impeller; the flow discharge region facing outwardly across the tank and being much larger than the inlet region. The radial component of the flow and the mechanical forces which can produce destructive stresses on the impeller, its shaft and seals around the shaft where it enters the tank are substantially eliminated by a vane in the discharge region in the immediate vicinity of the impeller. This vane presents a surface intersecting the radial component of the flow. The surface extends a predetermined distance in the axial direction away from the impeller and straightens the flow by reducing or substantially eliminating the radial component thereof. A plural impeller system has a plurality of such vanes in the discharge regions of each impeller. The flow is straightened in the immediate vicinity of the impeller so that surges in the medium being mixed as it circulates around the tank are substantially eliminated, thereby eliminating the stresses which can give rise to destructive failure modes.

The foregoing and other objects, features and advantages of the invention, as well as presently preferred embodiments thereof, will become more apparent from a reading of the following description in connection with the accompanying drawings in which.

Figure 1:
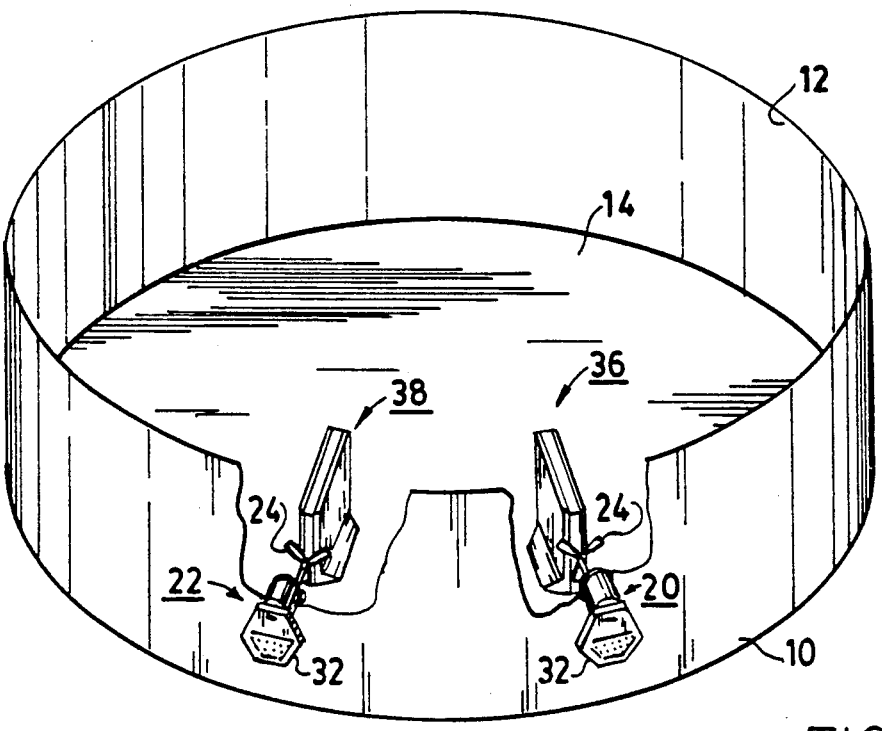
FIG. 1 is a perspective view, partially broken away and illustrating a tank, e.g., a paper pulp chest, in which the latent curl in paper pulp is taken out of the pulp in the mixing or agitation thereof.
Figure 2:
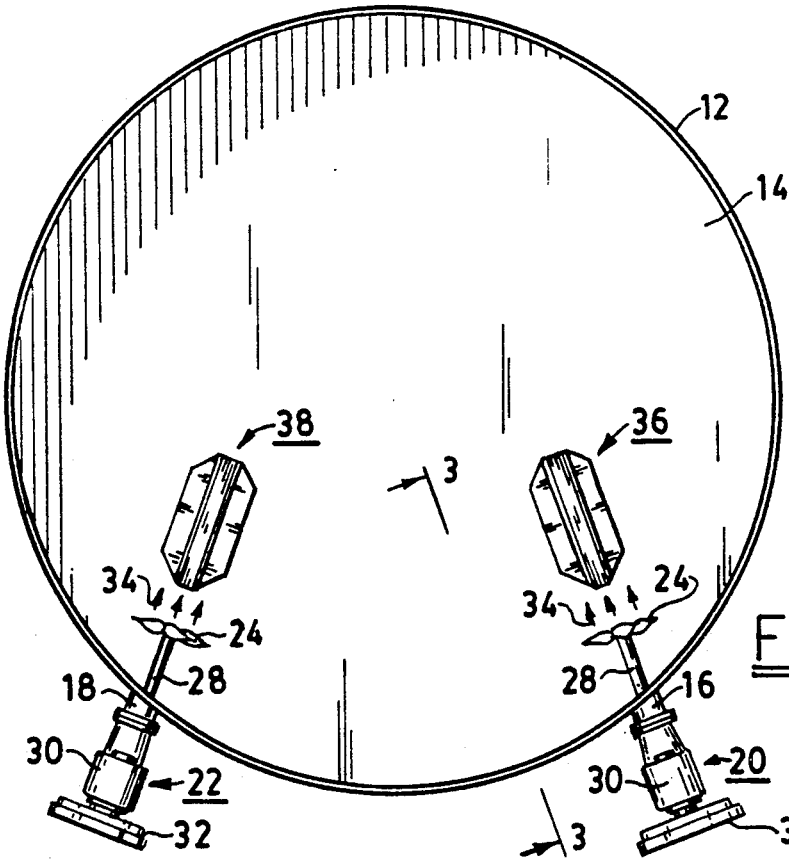
FIG. 2 is a plan view of the apparatus shown in FIG. 1.
Figure 3:
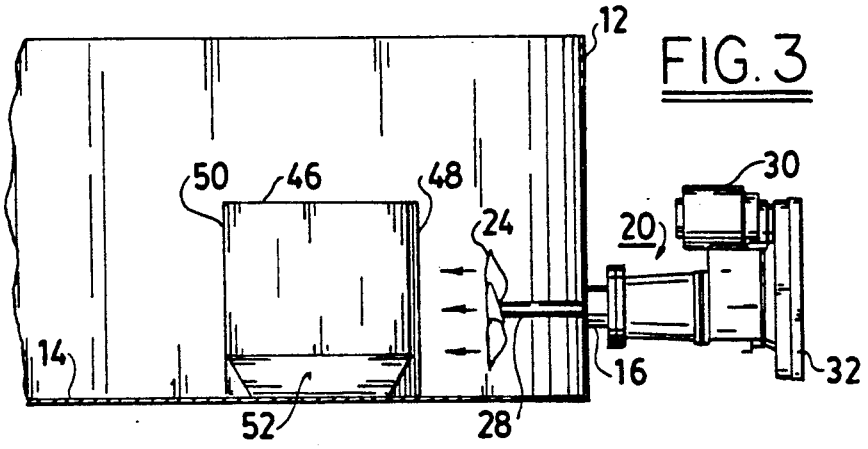
FIG. 3 is a front view of one of the side entering mixers, the view being taken along the line 3—3 in FIG. 2.

Referring more particularly to FIGS. 1 through 4, there is shown a tank 10 having a side wall 12 and a bottom 14. The tank is round but may be rectilinear in cross section (square or rectangular). Mounted on flanged nozzles 16 and 18 are side entering mixers 20 and 22. These mixers have impellers of the axial flow type (see, for example, U.S. Pat. No. 4,468,130 issued to Ronald J. Weetman on Aug. 28, 1984). These impellers 24 are mounted via a hub 26 to a shaft 28. The shaft passes through seals in the nozzle area which prevents the escape of the material in the tank through the nozzles 16 and 18. The shafts are driven by a motor 30 through a transmission, which in the case of the illustrated side entering mixer, is a belt drive in a housing 32. For further information with respect to a mixer of the type which may be used in the herein-illustrated apparatus, reference may be made to Bulletin B64 published by the Mixing Equipment Company (a unit of General Signal Corporation, Mt. Read Boulevard, Rochester, N.Y. (1989)) U.S. Pat. No. 3,887,169 of June 6, 1975 also shows an arrangement for mounting a side entering mixer in a side wall of a tank.

The impellers 24 project inwardly from the tank a relatively short distance equal to or slightly greater than the impeller's diameter. The inside or low pressure side of each impeller faces the side wall 12 and defines with that wall an inlet region into which flow circulates and then is pumped outwardly by the impeller in the direction of the arrows 34 into a discharge region. This discharge region extends from the front surface of the impeller to the wall 12 at locations opposite to the locations from which the impellers project. The impellers are both in the same hemisphere of the tank and are disposed with their axes of rotation bisecting a diameter of the tank; each at an acute angle to the diameter of the tank. The acute angle is preferably 20° (40° between projections of the rotational axes of the impellers 22 and 24). The impellers act in concert to cause the flow into the discharge regions thereof. The flow after reaching the locations on the wall of the tank opposite to the impellers recirculate backwardly to the inlet regions of each impeller.

The flow patterns overlap and the flows interact in the discharge regions. In the illustrated embodiment of the invention shown in FIGS. 1 through 4, the overlap occurs in the area of the diameter of the tank which is bisected by the rotational axes of the impellers and extends sidewise to the rotational axes of the impellers. It is in this overlap region that the radial components of the flow are believed to interact and interfere.

Every impeller, even an axial flow impeller, has a radial component. The radial component and the axial component add to provide a helical flow. Where the helical flow vectors interact the flow pulses or surges.

It is the interaction of the radial components which was found in accordance with the invention to give rise to the problem of mechanical forces and stresses on the impeller, its hub, its shaft and the seals around the shaft in the nozzle area. These forces vary because the flow entering the inlet regions of the impellers varies. The variation appears as surges in the flow. These surges can be measured in terms of the power required by the electrical motors 30 to drive the impellers 24. Where interactions do not exist, the power required by the electrical motors 30 to drive the impellers 24. Where interactions do not exist, the power drawn by the motors varies less than 1% of average power drawn by the motors. When surging is present the variation has been measured at from 5 to 6% of the average power drawn by the motors.

The forces due to the surging effect, apply stresses which cause flexural catastrophic failure of the impeller, the hubs and the shafts and leakage through the seals of the mixers 20 and 22. The problem is particularly evident in large tanks and especially large tanks having viscous material such as paper pulp (the viscosity of paper pulp). By a large tank is meant a tank the diameter or diagonal length of which is much greater than the diameter of the impeller, where the diameter of the impeller is D and the diameter or diagonal length of the tank is T, a large tank is one where D/T is from 0.02 to 0.1. It is in such tanks where the discharge regions are very long as compared to the inlet regions and the radial component of the flow has a long length (residence time) in which to interact and cause surging or pulsations in the flow which can give rise to catastrophic failure of the mixers.

An individual mixing apparatus may also have some interaction between the outward and recirculating flow due to the radial components of this flow. This interaction is not as severe as in the case illustrated in FIGS. 1 through 4 where two impellers are used. Two or more impellers are required where the material being mixed and circulated is viscous or heavy, or to achieve certain flow velocities and mixing rates. These interactions which can cause catastrophic failures of the mixers are substantially eliminated by a flow straightening vane. The vane in the form shown in FIGS. 1 through 4 is a plate-like structure. Two vane structures 36 and 38 are shown which are symmetrically disposed about the rotational axis of the impeller in the discharge region of which they are located. The vane structures are of masonary construction in this embodiment with a central core 40 of reinforced concrete and ceramic sheathing 42 and 44 on the side surfaces thereof. This sheathing is provided by ceramic tile. The vane structure has a top edge 46, a front edge 48 and a rear edge 50. The structure is supported in a masonry base 52 of the bottom 14 of the tank 10.

The straightening vanes 36 and 38 are in the immediate vicinity of the front side of the impellers 24. The front edge is preferably spaced approximately ½ D from the front side of the impeller. The base 52 is tapered away from the front edge 48 as is the ceramic sheating 42 and 44 so as to reduce interference with axial flow. A cap, for example of hemispherical tile, may be attached to the front edge also to reduce interference with the axial flow.

The height of the front edge is preferably at least 1½ D. The vane structures 36 and 38 are square or rectangular and the distance between the front and rear edges 48 and 50 (along the top edge 46) is at least 1½ D. The radial flow is intersected by the side surfaces of the straightening vane structures 36 and 38. By the time the flow reaches the rear edge 50, the radial component is substantially eliminated and axial flow continues to the side wall opposite the rear edge 50 and recirculates to the inlet regions of the impellers 24 without surging or pulsation.

Figure 10:
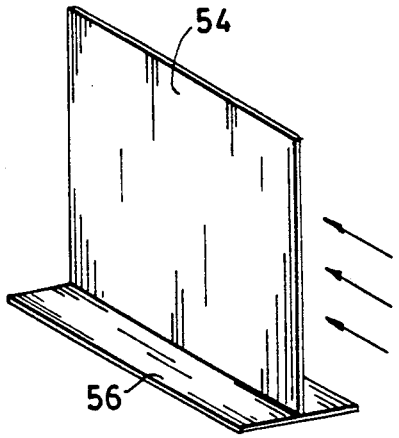
FIGS. 10, 11, 12 and 13 are views, in perspective in the case of FIGS. 10, 11 and 12 and a front view in the case of FIG. 13, of straightening vanes in accordance with different embodiments of the invention.

It is desirable that the vanes be as narrow in thickness as feasible. The masonry construction is preferred when a caustic solution such as paper pulp is used. It is desirable that the thickness (between the side surfaces) be less than 0.3 D. A flat plate 54 (FIG. 10) mounted on a base 56, which may be also a flat plate to which the straightening baffle plate 54 is connected by welding or suitable brackets (not shown), is desirable for use in applications where caustic materials are not mixed. The material of the plate 54 and base 56 may, for example, be stainless steel.

In a typical application, where the tank 10 is a paper pulp latency removal tank, the tank may have a diameter of about 37 feet. The length of the straightening vanes measured between their front and rear edges may be 6½ feet. The front edge may be located approximately 26 inches from the front surface of the impeller. The inlet region between the rear surface of the impeller and the wall of the tank may be approximately 33 inches. It has been found that in such a tank the problem of catastrophic failure due to flow pulsation or surge introduced stresses is substantially eliminated without interfering with the circulation of the pulp or the latency removal process.

Figure 4:
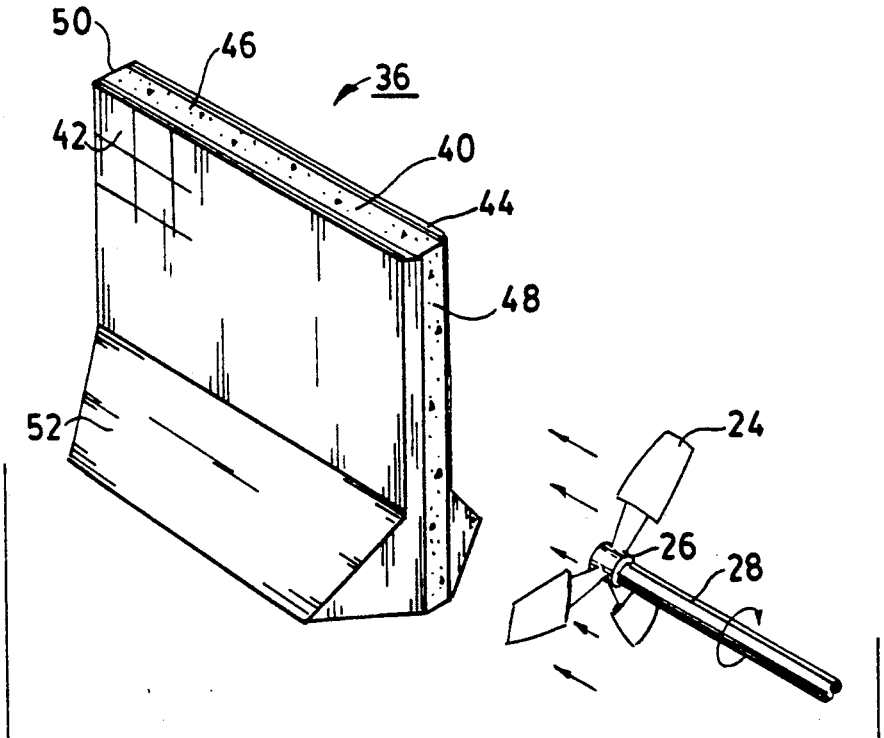
FIG. 4 is an enlarged perspective view of the impeller, impeller shaft and flow straightening vane shown in FIG. 3.
Figure 4A:
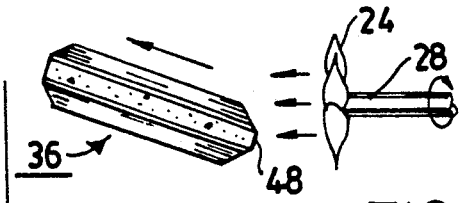
FIG. 4A is a plan view illustrating an orientation of the flow straightening vane with respect to the axis of rotation of the impeller.

When the invention is used the impellers of the mixers 20 and 22 may rotate in the same or in opposite senses. Rotation in opposite senses has been found to worsen the pulsation and surging in the pulp chest application discussed by way of specific example above. In the embodiment illustrated in FIGS. 1 to 4, the longitudinal plane of the vane structures 36 and 38 lies along the axis of rotation of the impeller. It may be desirable to tilt the structures so that the surface which takes out the rotational component is transversely to the rotational axis as shown in FIG. 4. The surface is inclined so that the angle between the side surface of the straightening vane maintains an optimum angle with the radial component, as the radial component is turned into the axial direction. As illustrated in FIG. 4A for a rotation in the clockwise sense of the impeller 24, the straightening vane is tilted clockwise about an axis perpendicular to the bottom of the tank. The tilt would be in the opposite sense if the flow were counterclockwise. In all cases, the surface and especially the front edge 48 of the straightening vane structure, is in the projection outwardly from the impeller of the area swept by the impeller (an area approximately equal to the diameter of the impeller around its axis of rotation).

Figure 5:
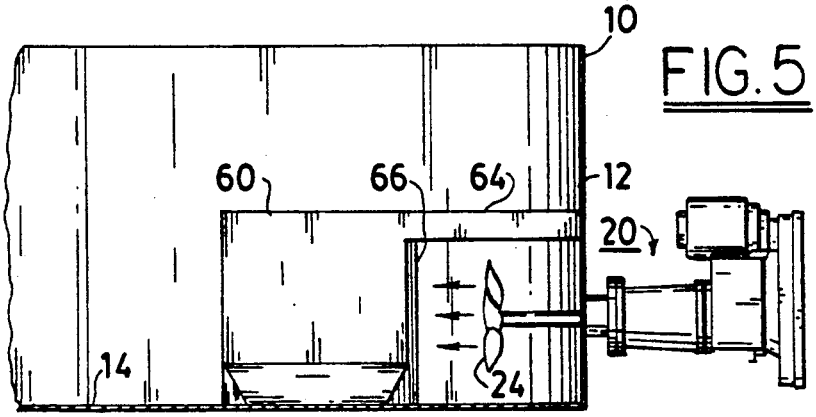
FIGS. 5, 6 and 7 are views similar to FIG. 3 of side entry mixer apparatus in accordance with different embodiments of the invention.
Figure 6:
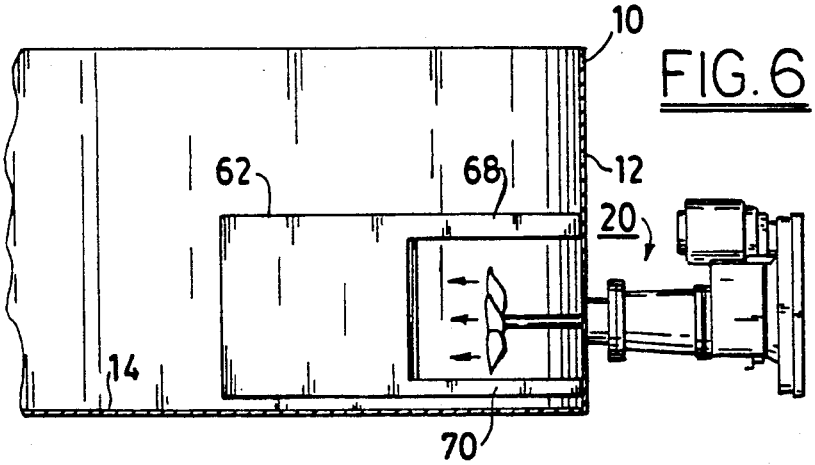

Referring to FIGS. 5 and 6, two different embodiments of straightening vane structures 60 and 62 are shown. The structure 60 is similar to the structure shown in FIGS. 1 through 4. However, an additional bar 64 is extended to the side wall 12 for additional support. The length of the front edge 66 of the straightening vane 60 which faces forward surface of the impeller 24 is greater than the diameter of the impeller 24 even though slightly foreshortened by the bar 64.

In the preceding FIGURES, the straightening vane structure was mounted on the bottom 14 of the tank 10. The vane structure 66 is mounted to the side wall 12 and is spaced slightly above (e.g., less than 20% of D) from the bottom 14 of the tank 10 and is supported by extensions 68 and 70 connected to the side wall 12 of the tank 10.

Figure 12:
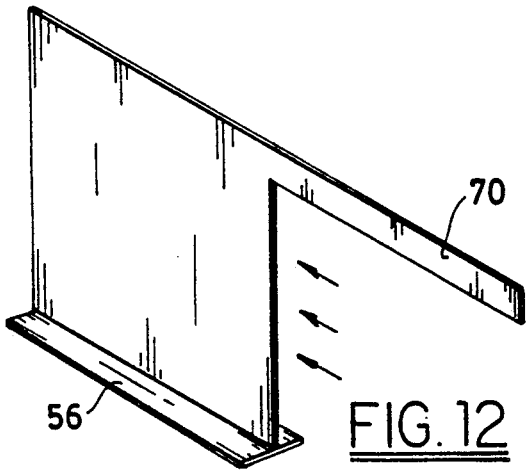
Figure 13:
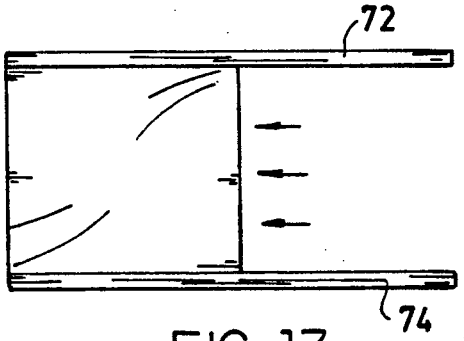

Referring to FIGS. 12 and 13, plate-like vane assemblies having extension bars 70 (FIG. 12) and 72 and 74 may be used for additional support or spacing above the bottom of the tank (with the structure of FIG. 13).

Figure 7:
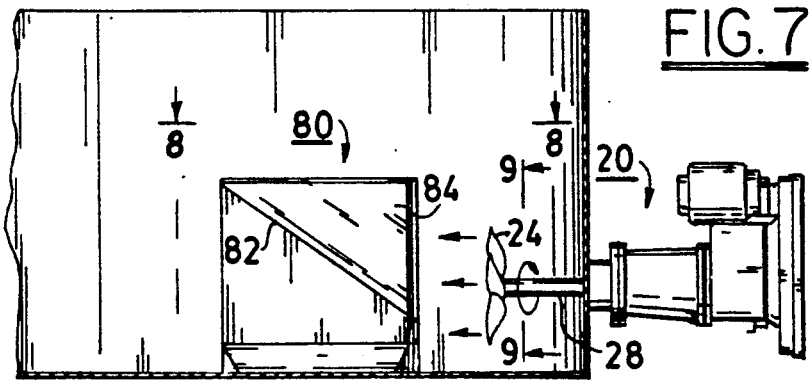
Figure 8:
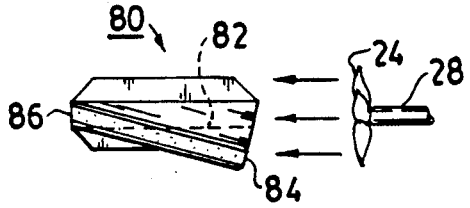
FIG. 8 is a fragmentary plan view taken along the line 8—8 in FIG. 7.
Figure 9:
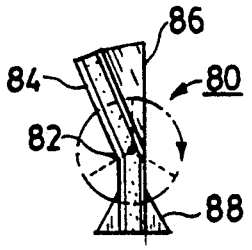
FIG. 9 is a fragmentary side view taken along the line 9—9 in FIG. 7.

Referring to FIGS. 7 through 9, there is shown a masonry constructed straightening vane structure 80 having a bend 82 so as to provide a bent over area for gradual flow straightening as was explained in connection with FIG. 4A. The front edge 84 faces the forward side of the impeller 24. The area of the folded or bent part of the structure 80 reduces in a direction between the front edge 84 and the rear edge 86 so as to provide for gradual flow straightening. The structure 80 is supported on a base 88 of design similar to the base 52 (FIG. 4).

Figure 11:
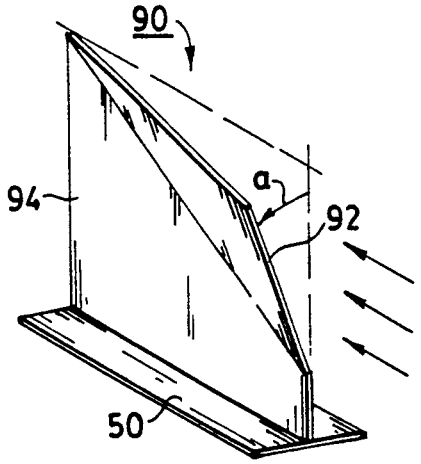

A bent vane structure 90 made from a single plate which serves the same purpose as the vane structure of FIGS. 7 through 9 (gradually straightening flow) is illustrated in FIG. 11. The angle a between the plane of the structure and the front edge 92 may suitably be approximately 15°. The area of the bent region of the structure 90 diminishes in the direction from the front edge 92 to the rear edge 94 thereof.

From the foregoing description, it will be apparent that there has been provided an improved mixing system using side entering mixers wherein catastrophic failures due to pulsating flow induced stresses is substantially eliminated. Variations and modifications in the herein described apparatus, within the scope of the invention, will undoubtedly suggest themselves to those skilled in the art. Accordingly, the foregoing description should be taken as illustrative and not in a limiting sense.

I claim:

1. In a mixer system wherein a liquid or liquid suspension is circulated in a tank having a side wall and a bottom, side entry mixer apparatus which comprises a mixer shaft having an axis, an impeller on said shaft and rotatable therewith about said axis, said impeller projecting inwardly of said tank from said side wall and defining a flow inlet region and flow discharge region on opposite sides thereof, said inlet region being defined between a portion of said side wall from which said impeller projects and one of said opposite sides of said impeller and said discharge region facing the other of the opposite sides of said impeller, said impeller having blades providing flow having components axially and radially of said axis into said discharge region which flow recirculates back to said inlet region, means for reducing the radial component of said flow in said inlet region which comprises a vane in said discharge region in the immediate vicinity of said impeller, said vane presenting a surface intersecting the radial component of said flow and permitting axial flow of the liquid, said surface extending a predetermined distance in the axial direction.

2. The apparatus according to claim 1, wherein a plurality of said mixer shafts are provided, each shaft having a different one of a plurality of impellers thereon, said impellers being rotatable with and about the axis of their respective shafts and projecting into said tank in generally the same direction, the spacing and orientation of said impellers being such that radial components of flow from said impellers interact, and said means for reducing the radial component of said flow comprises vanes in the discharge regions of said impellers in the immediate vicinities thereof, said vanes having surfaces intersecting the radial component of flow in said discharge regions, said surfaces extending in the axial direction of their respective impellers.

3. The apparatus according to claim 2, wherein each of said vanes has a front edge and a rear edge respectively closer and further away from the impeller in the discharge region of which it is disposed, said front edges being approximately ½ D from the side of said impeller facing said discharge region thereof, said front and rear edges being spaced by at least 1½ D from each other, D being the diameter of the one of said plurality of impellers in the discharge region of which the vane is disposed.

4. The apparatus according to claim 3, wherein each of said impellers sweeps an area as it rotates, said vane's front edges being of heights greater than the areas swept by the impellers in the discharge regions of which they are imposed as said impellers rotate and said front edges extending across said areas.

5. The apparatus according to claim 4, wherein said vanes have side faces with a thickness therebetween of up to 0.3 D of the impeller in the discharge regions of which they are disposed.

6. The apparatus according to claim 3, wherein each of said plurality of vanes has a bend in a direction opposite to the radial component of said flow in the discharge region in which it is disposed.

7. The apparatus according to claim 6, wherein the bend in each of said plurality of vanes defined a region between the front and rear edges along the corner thereof of area which decreases from said front edge towards said rear edge.

8. The apparatus according to claim 2, wherein said vanes comprise masonry walls having side surfaces of ceramic material, and bases supporting said walls from the bottom of said tank.

9. The apparatus according to claim 2, wherein the diameter or diagonal length of said tank across its said bottom is much larger than the diameter of any of said plurality of impellers such that said discharge regions of said impellers are much longer than said inlet regions thereof.

10. The apparatus according to claim 2, wherein said surfaces of each of said vanes are of an area of at least 1½ D in width across the axis of the one of said plurality of impellers in the discharge region of which it is disposed, at least 1½ D in length along the axis of the impeller in the discharge region of which said vane is disposed, where D is the diameter of the impeller in the discharge region of which said vane is disposed.

11. The apparatus according to claim 1, wherein said vane has a front edge and a rear edge respectively closer and further away from said impeller, said front edge being approximately ½ D from said other side of said impeller along the axis of rotation thereof, and the distance between said front and rear edges being at 1½ D, where D is the diameter of said impeller.

12. The apparatus according to claim 11, wherein said impeller sweeps an area as it rotates, said front edge being of a height greater than the diameter of said area and extending across said area.

13. The apparatus according to claim 12, wherein said vane has side faces with thickness between said side faces of up to 0.3 D.

14. The apparatus according to claim 11, wherein said vane has a bend in a direction opposite to the direction of the radial component of said flow.

15. The apparatus according to claim 14, wherein said bend defines a region between the front and rear edges of said impeller along the corner of said vane, said region of said vane decreasing in area from said front edge towards said rear edge.

16. The apparatus according to claim 1, wherein said vane has a bottom edge, a top edge, a front edge and a rear edge, means supporting said bottom edge on or next to the bottom of said tank with said front edge extending across the area swept by said impeller as it rotates.

17. The apparatus according to claim 16, wherein said support means comprises a support selected from the group consisting of a base on the bottom of said tank, on which said vane is disposed and one or more bars extending from said top edge, said bottom edge or both of said top and bottom edges leaving between said bars a length of said front edge longer than the area swept by said impeller.

18. The apparatus according to claim 1, wherein said vanes each have a top edge, a bottom edge, a front edge, and a rear edge, means attached to said vanes for supporting said vanes with said bottom edges on or next to the bottom of said tank and with the front edges of said vanes extending across the area swept by the impeller in the discharge region of which it is disposed.

19. The apparatus according to claim 18, wherein said support means comprises supports selected from the group consisting of a base on the bottom of said tank in which said vanes are disposed and one or more bars extending from the top edge of said vanes, said bottom edge or both of said top or bottom edges leaving between said bars a length of said front edge longer than the area swept the one of said impellers in the discharge region of which said vane is disposed.

20. The apparatus according to claim 1, wherein said vane comprises a masonry wall having side surfaces of ceramic material, and a base supporting said wall on the bottom of said tank.

21. The apparatus according to claim 1, wherein said impeller has a diameter D and said tank has a diameter or diagonal length T and wherein the ratio of D to T (D/T) is in the range of about 0.02 to 0.1.

22. The apparatus according to claim 1, wherein said surface intersects said axis and is at least $1\frac{1}{2}$ D by $1\frac{1}{2}$ D in area, wherein D is the diameter of said impeller.

* * * * *